US008966869B2

(12) United States Patent
Hundeloh et al.

(10) Patent No.: US 8,966,869 B2
(45) Date of Patent: Mar. 3, 2015

(54) METHOD FOR FILLING FOOD CONTAINERS

(75) Inventors: Thomas Hundeloh, Bad Marienberg (DE); Georg Janssen, Windhagen (DE); Bernd Ullmann, Pfinzial (DE); Maril Kamp, Ijselmulden (DE)

(73) Assignee: Ball Packaging Europe GmbH, Ratingen (DE)

( * ) Notice: Subject to any disclaimer, the term of this patent is extended or adjusted under 35 U.S.C. 154(b) by 231 days.

(21) Appl. No.: 13/319,727

(22) PCT Filed: May 12, 2010

(86) PCT No.: PCT/EP2010/056578

§ 371 (c)(1), (2), (4) Date: Nov. 10, 2011

(87) PCT Pub. No.: WO2010/130797

PCT Pub. Date: Nov. 18, 2010

(65) Prior Publication Data

US 2012/0090727 A1 Apr. 19, 2012

(30) Foreign Application Priority Data

May 12, 2009 (DE) ..... 10 2009 003 025

(51) Int. Cl.

*B65B 31/04* (2006.01)
*B65B 31/02* (2006.01)
*B67C 3/02* (2006.01)
(Continued)

(52) U.S. Cl.

CPC ... *B67C 3/02* (2013.01); *B65B 3/18* (2013.01); *B65B 7/2857* (2013.01); *B65B 31/025* (2013.01); *B67C 2003/2657* (2013.01)
USPC ..... 53/432

(58) Field of Classification Search

CPC ..... B65B 3/04; B65B 7/00; B65B 31/025; B65D 51/20; B67D 1/1252
USPC ..... 53/432, 471, 485, 488, 489, 510, 511, 53/281
See application file for complete search history.

(56) References Cited

U.S. PATENT DOCUMENTS 3,912,117 A * 10/1975 Ryding ..... 220/293
4,893,452 A * 1/1990 Bruce et al. ..... 53/420
(Continued)

FOREIGN PATENT DOCUMENTS

DE 19817735 C1 11/1999
EP 1847336 A1 10/2007
(Continued)

OTHER PUBLICATIONS

International Search Report prepared by the European Patent Office on Sep. 24, 2010, for International Application No. PCT/EP2010/056578.
(Continued)

*Primary Examiner* — Robert Long
(74) *Attorney, Agent, or Firm* — Sheridan Ross P.C.

(57) ABSTRACT

The invention relates to a method for filling thin wall food containers, in particular beverage cans, which are eventually closed gas-tight and have an inner pressure that is above ambient pressure for stabilizing the food container. The method includes the steps of providing the food container with an open filling orifice in a filling station; filling the food container in the filling station; covering the filling orifice of the food container with a lid directly after completing the filling process; fixating the lid at the food container without closing the food container gas-tight; and transporting the food container with the filling opening covered.

27 Claims, 3 Drawing Sheets

Figure 1:
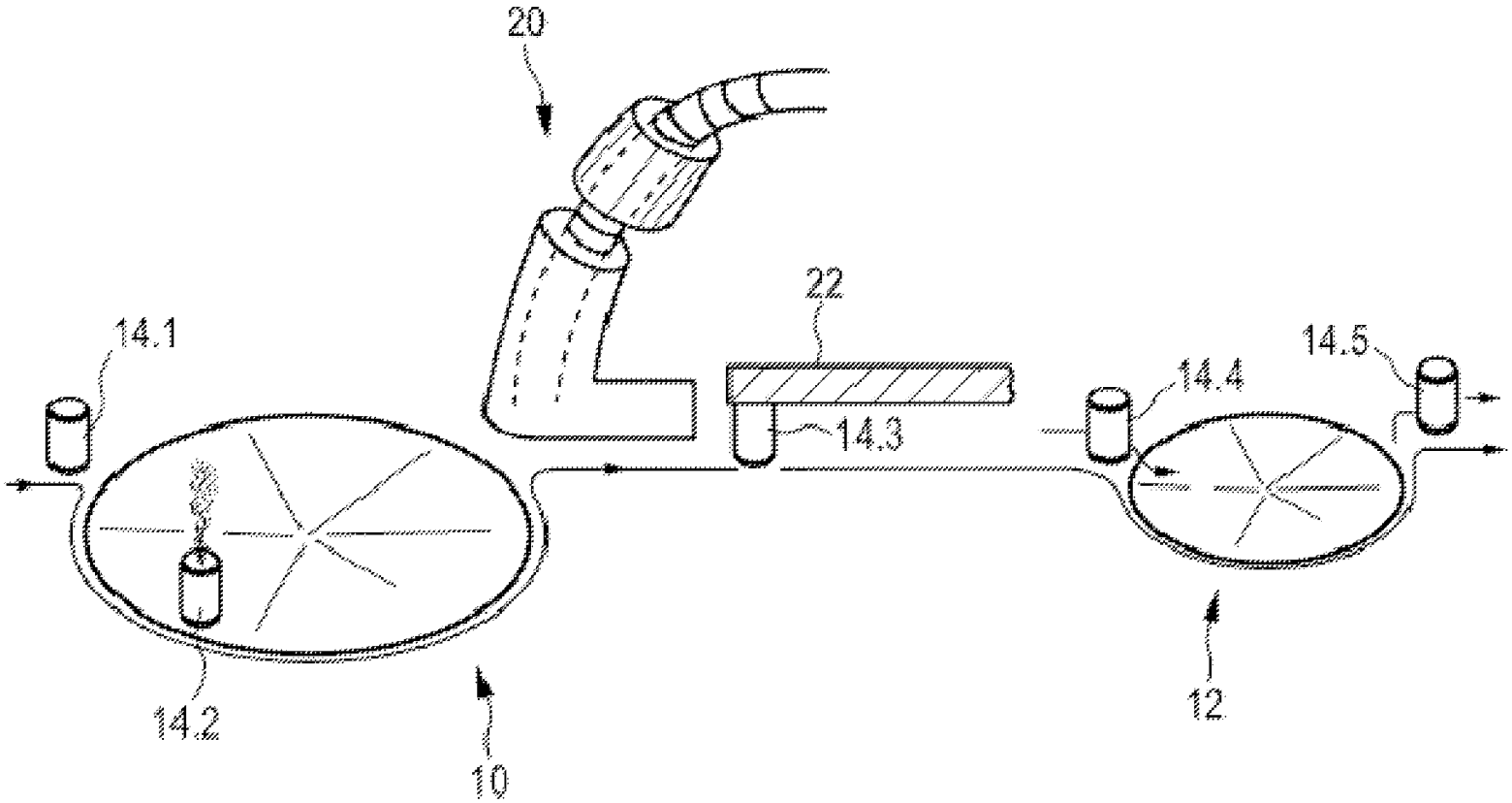

(51) Int. Cl.

| | |
|---|---|
| ***B65B 3/18*** | (2006.01) |
| ***B65B 7/28*** | (2006.01) |
| *B67C 3/26* | (2006.01) |

(56) References Cited

U.S. PATENT DOCUMENTS

| | | | | | |
|---|---|---|---|---|---|
| 5,054,265 | A | * | 10/1991 | Perigo et al. | 53/425 |
| 5,095,886 | A | * | 3/1992 | Schmed | 220/240 |
| 5,115,938 | A | * | 5/1992 | Thompson | 220/618 |
| 5,402,623 | A | * | 4/1995 | Ahlers | 53/471 |
| 5,802,812 | A | * | 9/1998 | Heudecker | 53/431 |
| 5,804,237 | A | * | 9/1998 | Diamond et al. | 426/131 |
| 5,916,110 | A | * | 6/1999 | Sanfilippo et al. | 53/510 |
| 6,457,299 | B1 | | 10/2002 | Schwenke et al. | |
| 2012/0205403 | A1 | * | 8/2012 | Neukirch et al. | 222/394 |

FOREIGN PATENT DOCUMENTS

| | | | | |
|---|---|---|---|---|
| EP | 1911677 | A1 | | 4/2008 |
| GB | 1247879 | A | | 9/1971 |
| GB | 2070995 | A | * | 8/1986 |
| JP | S59-187517 | | | 10/1984 |
| JP | S60-021096 | | | 2/1985 |
| JP | 2001-505513 | | | 4/2001 |
| JP | 2002-512156 | | | 4/2002 |
| JP | 2003-003509 | | | 1/2003 |
| JP | 2007-039116 | | | 2/2007 |
| JP | 2008-539132 | | | 11/2008 |
| RU | 10397 | | | 7/1999 |
| WO | WO 2005/044667 | | | 5/2005 |

OTHER PUBLICATIONS

Official Action (English translation) for Japanese Patent Application No. 2012-50299, mailed Oct. 7, 2013, 4 pages.

Official Action (with English translation) for Russian Application No. 2011150278, dated Jun. 4, 2014, 8 pages.

* cited by examiner

METHOD FOR FILLING FOOD CONTAINERS

CROSS REFERENCE TO RELATED APPLICATIONS

This application is a national stage application under 35 U.S.C. 371 of PCT Application No. PCT/EP2010/056578 having an international filing date of 12 May 2010, which designated the United States, which PCT application claimed the benefit of German Application No. 102009003025.5 filed 12 May 2009, the entire disclosure of each of which are hereby incorporated by reference.

The invention relates to a method for filling food containers which are eventually closed gas-tight and have an inner pressure that is above ambient pressure. The invention relates in particular to a method for filling thin walled food containers which require an inner pressure that is above ambient pressure in order to stabilize the food container. Food containers of this type are known e.g. as beverage cans.

When filling food containers, in particular when pouring liquid food like beverages, there is the basic problem of a slosh-over. The sloshed over food can then form a breeding ground for microbiological growth in the plant for filling and closing the food container. As a result, a contamination of the entire plant occurs. This in turn leads to the risk that a respectively freshly filled food container and in particular its filling material is microbiologically re-contaminated.

In order to prevent this, it is customary today to frequently shut down and clean such plants for filling and closing such food containers. Alternatively, or as a supplement thereto, the food container is heat-treated after filling in order to pasteurize or sterilize the content.

It is the object of the invention to reduce or prevent this complexity.

According to the invention, the object is achieved through a method for filling food containers as recited supra including the following steps:

- Providing a food container with an open filling orifice in a filling station;
- Filling the food container in the filling station;
- Covering the filling orifice of the food container with a lid directly after completing the filling process;
- Fixating the lid at the food container without closing the food container gas-tight; and
- Transporting the food container away with the filling opening covered.

Preferably, the cover used for covering the filling opening is already the cover which is eventually provided for durable and gas-tight closure of the food container, wherein the cover is preferably already only attached in the filling station or directly adjacent thereto and the food container accordingly is not permanently closed.

It is rather preferably provided that fixating the cover at the food container is performed so that gas can permeate out from the covered food container into the ambient. For carbonated beverages, a CO2 atmosphere can form this way above the liquid level and air that may be provided is being displaced.

Fixating the cover can be provided in that the cover is slightly deformed after placement onto the recently filled food container, but so that the cover is not yet connected in a tight and sealed manner with the food container.

According to a preferred alternative, the cover is placed on the filled food container so that the cover is connected with the food container through clamping. In this context, it is preferred in particular when the food container is covered with a lid which includes an exterior diameter in the portion of a core bevel, wherein the interior diameter is greater than an inner diameter, also designated as flange inner diameter of the filled container.

As an alternative thereto, the cover can also be fixated at the food container in a passive manner in that it is pressed onto the food container through an external device like a compression rail or similar.

Preferably, the covered food container is transported after filling and covering from a respective filling station to a respective closing station where it is eventually closed permanently gas-tight. This can be performed e.g. in a known manner through folding over.

The invention is based on the idea that immediately covering the food container after filling reliably prevents a re-contamination in that a penetration of germs into the container is prevented. Simultaneously, covering has the consequence that less or no filling material can slosh over so that a contamination of the respective plant only occurs to a much lesser extent if it occurs at all. Furthermore, a simple fixation of a cover at the food container can ideally be achieved much more easily than a final closure. In a preferred ideal case, a respective cover is simply only pressed onto a flange surrounding the filling opening of a respective food container. A gas-tight closing of the food container shall thus explicitly not be performed in order to initially allow the gas to exit from the food container. This has the consequence that germs which are in the vicinity of the covered packaging do not get into the interior of the can. This reduces the re-contamination risk. Furthermore, oxygen can be displaced from the atmosphere above a liquid level in the filled food container and can exit.

Preferably, the cover has a slightly inward pulled edge with an inner diameter over the entire edge that is slightly smaller than an outer diameter of the bottle of the flange of a respective food container enclosing the respective filling opening. In this case, the cover is clamped onto the food container and fixated in this manner. Alternatively, also a cover with an inner diameter over the entire edge can be provided which initially has the same size or slightly larger size than a respective bottle outer diameter of a respective food container. In this case, the cover is pressed onto the food container e.g. through a plunger so that the edge of the cover is slightly deformed and pressed inward so that an edge width inner diameter after being pressed onto the food container is smaller than the flange outer diameter of the food container. As a result, also here the cover is fixated at the food container without the food container being permanently closed by the cover.

The permanent and gas-tight closing is preferably only performed in a closing station, thus preferably through known folding over. Thus, the covered food container is transported from a filling station to a closing station. Preferably, the transport path thus provided is straight and preferably the already filled and covered food pump container is not accelerated on the transport path. It is particularly preferred that the initially empty food container is transported on a circular track to the filling location at the filling station and subsequently transported on a tangent to the circular track from the filling station to the closing station. This way, accelerations of the filled food container which can cause the content to slosh are avoided whenever possible.

The covers for covering and subsequently closing the food container are provided to the food container in the filling station preferably under a protective gas atmosphere in order to assure that the cover itself does not already lead to a contamination of the food container or of the filling material.

Furthermore, the oxygen content of the gas atmosphere above the liquid container in the filled food container is reduced.

Eventually, it is preferred that the food container is filled with a liquid food which either includes carbonation, thus which is e.g. a carbonated drink or an additional gas like carbon dioxide or nitrogen is supplied to the food container in liquid or solid form in order to cause that the supplied gas can gas out on the transport path between the filling station and the closing station and can thus possibly displace an oxygen including atmosphere that is disposed above the liquid level in the filled food container. In this context, it is appreciated that gas means a substance which is gaseous at room temperature. This means that the substance that is gaseous at room temperature, designated herein as gas, can be liquid or solid when it is supplied to the respective food container to be filled at a much lower temperature.

Figure 2:
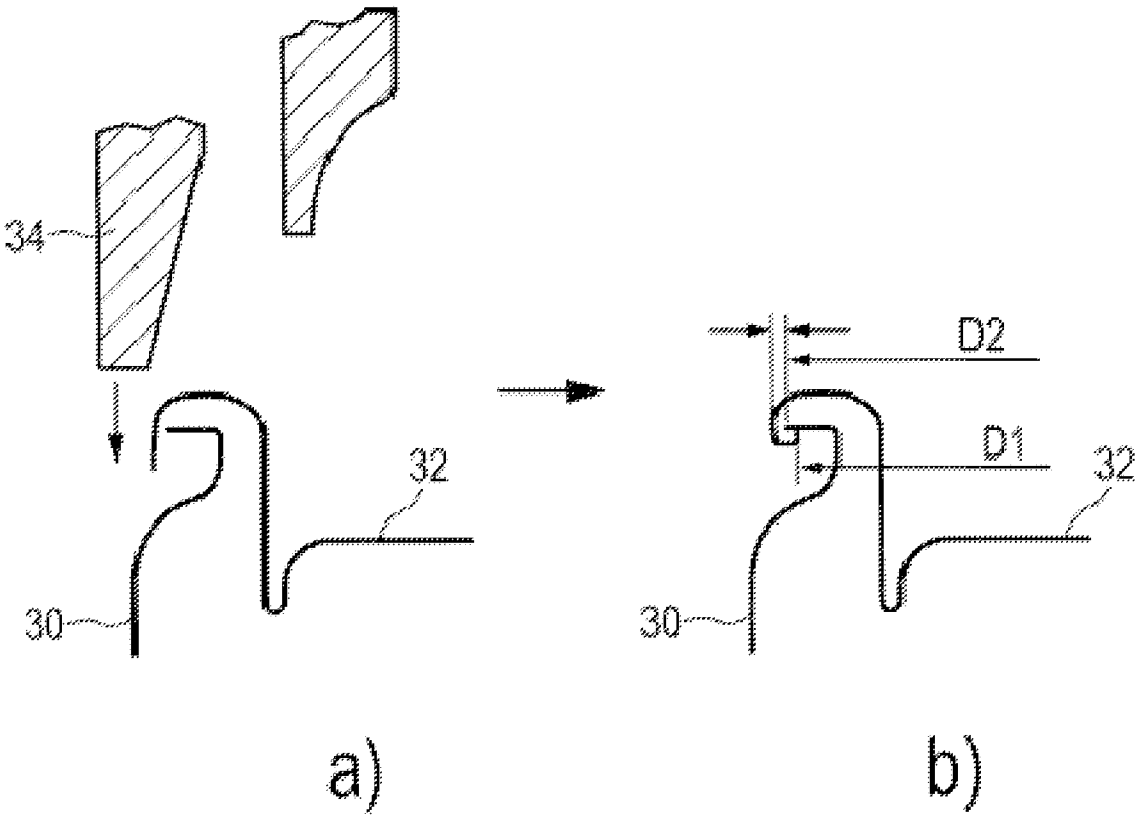
Figures 3A, 3B:
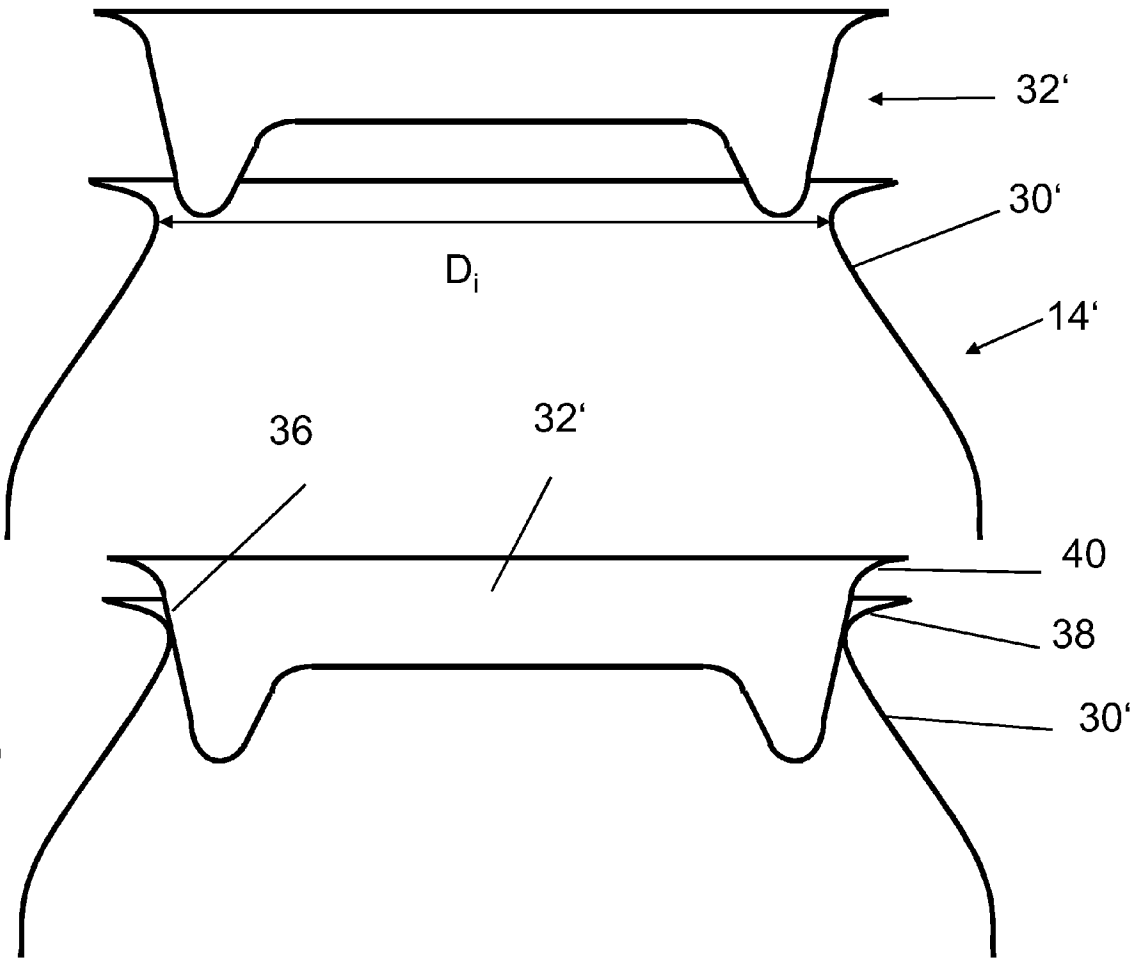

The invention shall now be described based on embodiments with reference to the drawing, wherein:

FIG. 1 illustrates the basic principle of the invention;

FIGS. 2*a* and 2*b* illustrate the active fixation of a cover at a food container during covering the food container directly after filling; and FIGS. 3*a* and 3*b* illustrate sketches of a cover and of a food material before and after the cover is clamped onto the container.

FIG. 1 illustrates an exemplary combination of a filling station 10 and a closing station 12 through which a food container 14 can initially be filled with a beverage and can subsequently be closed tight with a cover.

The filling station 10 is only indicated. For example an empty beverage can 14.1 is illustrated which is supplied to the filling station 10. In an exemplary manner, also a can 14.2 is illustrated as a food container which is filled in the filling station. Another can 14.3 is transported from the filling station 10 to the closing station 12. A can 14.2 reaches the closing station 12. In the closing station 12, a cover is permanently connected with the can in a known manner through folding over so that the can is subsequently closed tight. A tightly closed can 14.2 of this type is also indicated in FIG. 1.

Differently from the known device, a cover supply 20 is provided directly adjacent to the filling station 10 through which a respective cover is provided to a respectively filled can through which the can is subsequently closed tight and permanently through folding over in the closing station 12.

Through the cover supply 20, a cover is supplied to each filled can so that the can is covered with a cover directly after filling, so that gas can exit from the interior of the can to the outside, but no germs can penetrate from the outside into the interior of the covered can. Supplying the covers to the cans filled in the filling station 10 is performed under a protective gas atmosphere, thus in a CO2 atmosphere in order to assure that germs are not already enclosed when the covers are placed onto the just filled food containers.

On the transport path from the filling station 10 to the closing station 12 the cover of the respective can (14.3) is fixated so that it cannot fall off. This is performed in the embodiment illustrated in FIG. 1 through a compression rail 22 which is arranged above the transport path between the filling station 10 and the closing station 12 and which prevents the cover from falling off in the transport path. This way a respective cover is fixated at the respective food container, thus the respective can, in a passive manner.

As an alternative thereto, a respective cover can also be placed on the opening of the respective food container so that it is actively fixated at the food container, thus so that it adheres to the food container without additional devices.

FIG. 2 illustrates an example of this embodiment. The upper edge of a typical beverage can 30 is indicated which includes the filling opening. An edge portion of the cover 32 is also indicated, wherein the filling opening of the can 30 is closed through the cover.

FIG. 2*a* illustrates how a deformation of the edge portion 36 of the cover 32 can be provided through a punch so that an edge width inner diameter D1 (c.f. FIG. 2*b*) is provided which is smaller than a flange outer diameter D2 of the upper edge of the food container 30.

It is appreciated that FIG. 2 only illustrates a portion of an overall rotation symmetrical punch 34. Thus, a portion of the punch 34 is illustrated which engages the upper edge of the cover 32 and deforms the cover so that the diameter properties illustrated in FIG. 2*b* are provided.

FIGS. 3*a* and 3*b* respectively illustrate a flange 30' of a can 14' and a cover 32'. The flange 30' has an inner flange diameter $D_1$. The flange inner diameter is the smallest inner width of the opening of the can 14'.

The cover 32' as usual has a beveled circumferential wall which is designated as a core bevel 36.

In the embodiment depicted in FIGS. 3*a* and 3*b*, the cover 32' is configured so that it has an exterior diameter in the area of its core bevel 36, wherein the exterior diameter is greater than the inner flange diameter $D_i$. Thus, the cover 32' can clamp onto the flange 30' of the can 14' as illustrated in FIG. 3*b*. In this case, the cover 32' is fixated through clamping its core bevel 36 with the flange 30' of the can 14' at the can 14'.

The flange 30' and also the cover 32' respectively include a rolled portion 38 or 40 which facilitates closing the can 14' finally and permanently through the cover 32' in a closing station through a typical double fold.

The invention claimed is:

1. A method for filling beverage cans, which are eventually closed gas-tight and have an inner pressure that is above ambient pressure for stabilizing a beverage can including the steps:

providing the beverage can with an open filling orifice in a filling station;

filling the beverage can in the filling station;

covering the filling orifice of the beverage can with a lid directly after completing the filling process;

fixating the lid at the beverage can without closing the beverage can gas-tight; and transporting the beverage can with the filling opening covered;

wherein the filling opening of the beverage can is covered by the lid which is eventually provided for permanent gas-tight closure of the beverage can, wherein the lid after filling in the filling station is only fixated but not permanently closed;

wherein the lid is pressed onto the beverage can from above and in a direction substantially parallel to the longitudinal axis of the beverage can;

wherein the lid is provided with an edge width inner diameter which is slightly smaller than a flange outer diameter of the beverage can; and wherein the lid is snap-locked onto the respective beverage can.

2. The method according to claim 1, wherein the beverage can is transported with a covered filling opening from the filling station to a closing station and closed in the closing station permanently gas-tight.

3. The method according to claim 1, wherein the lid is fixated at the beverage can directly after filling or directly after the filling station so that gas can move outward from the covered beverage can.

4. The method according to claim 2, wherein the lid and the beverage can are connected permanently gas-tight with one another in the closing station through folding or border crimping.

5. The method according to claim 1, wherein the lid for covering the beverage can is supplied to the beverage can under an inert gas atmosphere.

6. The method according to claim 1, wherein the beverage can is filled with a beverage that includes carbonation.

7. The method according to claim 1, wherein the beverage can is filled with a liquid food and an inert gas.

8. The method according to claim 7, wherein the gas is filled into the beverage can in liquid or solid form.

9. The method according to claim 2, wherein the beverage can is moved to the filling station on a circular path and moved on a tangent to the circular path to the closing station after being filled in the filling station.

10. A method for filling beverage cans, which are eventually closed gas-tight and have an inner pressure that is above ambient pressure for stabilizing a beverage can including the steps:

providing the beverage can with an open filling orifice in a filling station;

filling the beverage can in the filling station;

covering the filling orifice of the beverage can with a lid directly after completing the filling process;

fixating the lid at the beverage can without closing the beverage can gas-tight; and transporting the beverage can with the filling opening covered;

wherein the filling opening of the beverage can is covered by the lid which is eventually provided for permanent gas-tight closure of the beverage can, wherein the lid after filling in the filling station is only fixated but not permanently closed;

wherein the lid is pressed onto the beverage can from above and in a direction substantially parallel to the longitudinal axis of the beverage can;

wherein the lid comprises an edge width inner diameter which initially has the same size as the flange outer diameter of the beverage can or which is slightly larger than a respective beverage can; and wherein the lid is slightly deformed during pressing onto the beverage can so that its edge width inner diameter as a consequence is smaller than the flange outer diameter of the respective beverage can.

11. The method according to claim 10, wherein the beverage can is transported with a covered filling opening from the filling station to a closing station and closed in the closing station permanently gas-tight.

12. The method according to claim 10, wherein the lid is fixated at the beverage can directly after filling or directly after the filling station so that gas can move outward from the covered beverage can.

13. The method according to claim 11, wherein the lid and the beverage can are connected permanently gas-tight with one another in the closing station through folding or border crimping.

14. The method according to claim 10, wherein the lid is supplied to the beverage can under an inert gas atmosphere.

15. The method according to claim 10, wherein the beverage can is filled with a beverage that includes carbonation.

16. The method according to claim 10, wherein the beverage can is filled with a liquid food and an inert gas.

17. The method according to claim 16, wherein the gas is filled into the beverage can in liquid or solid form.

18. The method according to claim 11, wherein the beverage can is moved to the filling station on a circular path and moved on a tangent to the circular path to the closing station after being filled in the filling station.

19. A method for filling beverage cans, which are eventually closed gas-tight and have an inner pressure that is above ambient pressure for stabilizing a beverage can including the steps:

providing the beverage can with an open filling orifice in a filling station;

filling the beverage can in the filling station;

covering the filling orifice of the beverage can with a lid directly after completing the filling process;

fixating the lid at the beverage can without closing the food container gas-tight; and transporting the beverage can with the filling opening covered;

wherein the filling opening of the beverage can is covered by the lid which is eventually provided for permanent gas-tight closure of the beverage can, wherein the lid after filling in the filling station is only fixated but not permanently closed;

wherein the lid is pressed onto the beverage can from above and in a direction substantially parallel to the longitudinal axis of the beverage can;

wherein the lid is provided which has an outer diameter in a portion of its core bevel, wherein the outer diameter is greater than an opening inner diameter $D_i$ of a respective beverage can; and the lid is placed onto a respective filled beverage can so that the lid is eventually connected in a clamping manner with the beverage can.

20. The method according to claim 19, wherein the beverage can is transported with a covered filling opening from the filling station to a closing station and closed in the closing station permanently gas-tight.

21. The method according to claim 19, wherein the lid is fixated at the beverage can directly after filling or directly after the filling station so that gas can move outward from the covered beverage can.

22. The method according to claim 20, wherein the lid and the beverage can are connected permanently gas-tight with one another in the closing station through folding or border crimping.

23. The method according to claim 19, wherein the lid for covering a beverage can is supplied to the beverage can under an inert gas atmosphere.

24. The method according to claim 19, wherein the beverage can is filled with a beverage that includes carbonation.

25. The method according to claim 19, wherein the beverage can is filled with a liquid food and an inert gas.

26. The method according to claim 25, wherein the gas is filled into the beverage can in liquid or solid form.

27. The method according to claim 20, wherein the beverage can is moved to the filling station on a circular path and moved on a tangent to the circular path to the closing station after being filled in the filling station.

* * * * *